US005364171A

United States Patent [19]

Addington et al.

[11] Patent Number: 5,364,171

[45] Date of Patent: * Nov. 15, 1994

[54] APPARATUS AND METHOD FOR CONTINUOUS MINING

[75] Inventors: Larry C. Addington; Robert R. Addington; Larry M. Addington, all of Catlettsburg; Albert E. Lynch, Flatwoods, all of Ky.; John Susla, Charleston; David L. Conley, Huntington, both of W. Va.; John J. Sartaine, Russell; David E. Price, Solder, both of Ky.

[73] Assignee: Mining Technologies, Inc., Ashland, Ky.

[ * ] Notice: The portion of the term of this patent subsequent to Nov. 16, 2010 has been disclaimed.

[21] Appl. No.: 140,368

[22] Filed: Oct. 21, 1993

Related U.S. Application Data

[63] Continuation of Ser. No. 795,314, Nov. 20, 1991, Pat. No. 5,261,729, which is a continuation-in-part of Ser. No. 625,211, Dec. 10, 1990, Pat. No. 5,112,111.

[51] Int. Cl.[5] ..... E21C 29/00; E21C 35/20

[52] U.S. Cl. ..... 299/18; 198/594; 299/57; 299/67

[58] Field of Search ..... 299/18, 56, 57, 64, 299/67; 175/62; 198/303, 583, 584, 588, 594; 213/75 R; 105/3

[56] References Cited

U.S. PATENT DOCUMENTS

| | | | |
|---|---|---|---|
| Re. 31,622 | 7/1984 | Todd | 299/18 X |
| 1,932,897 | 10/1933 | Jaggard | 198/588 X |
| 2,780,451 | 2/1957 | Alspaugh et al. | 198/303 X |
| 2,796,999 | 6/1957 | Russell | 198/303 X |
| 2,872,170 | 2/1959 | Alspaugh et al. | 299/57 X |
| 3,135,502 | 6/1964 | Muehlman | 299/56 |
| 3,191,754 | 6/1965 | Heimaster et al. | 198/303 |
| 3,497,055 | 2/1970 | Oslakovic et al. | 198/303 |
| 3,726,562 | 4/1973 | Wharton, III | 299/12 |
| 4,014,574 | 3/1977 | Todd | 299/18 X |
| 4,021,076 | 5/1977 | Hawthorne et al. | 299/56 |
| 4,036,529 | 5/1977 | Hawthorne et al. | 299/56 |
| 4,256,213 | 3/1981 | Shaw et al. | 198/303 |
| 4,646,906 | 3/1987 | Wilcox, Jr. et al. | 198/303 |
| 4,699,429 | 10/1987 | Maybrier et al. | 299/7 |
| 4,953,915 | 9/1990 | Jasser et al. | 299/18 |
| 4,986,412 | 1/1991 | Brais | 299/67 X |

*Primary Examiner*—David J. Bagnell
*Attorney, Agent, or Firm*—King and Schickli

[57] ABSTRACT

An apparatus for mining aggregate material from a seam includes a miner for cutting material from the seam and a conveyor for conveying the won aggregate material from the miner for recovery. The conveyor is formed by a series of individual conveyor units that are coupled or interconnected in series so as to form a train. The coupling comprises cooperating clevises and tongues interconnected by locking pins. Each unit includes a main frame supported on ground engaging wheels. A belt conveyor is supported in the main frame and a conveyor drive mechanism is provided on each unit. The apparatus also includes a launch vehicle. The launch vehicle includes a frame holding a conveyor for receiving won aggregate material from the conveyor train and for delivering that material to a discharge conveyor. Additionally, the launch vehicle includes a reciprocating drive assembly to aid in advancing the conveyor train and miner into the seam face. In an alternative embodiment, the launch vehicle is replaced with a self propelled pusher unit.

29 Claims, 6 Drawing Sheets

APPARATUS AND METHOD FOR CONTINUOUS MINING

This is a continuation of U.S. Pat. application Ser. No. 07/795,314, filed Nov. 20, 1991, issued as U.S. Pat. No. 5,261,729 on Nov. 16, 1993 and entitled "Apparatus and Method for Continuous Mining" which is a continuation-in-part of U.S. Pat. application Ser. No. 07/625,211, filed Dec. 10, 1990, entitled "Apparatus and Method for Continuous Mining" now issued as U.S. Pat. No. 5,112,111.

TECHNICAL FIELD

The present invention relates generally to the art of mining and, more particularly, to an improved apparatus and method for mining aggregate material, such as coal, from situ.

BACKGROUND OF THE INVENTION

Coal, formed from decomposed and compressed vegetable matter, is typically found in substantially horizontal seams extending between sedimentary rock strata such as limestone, sandstone or shale. Surface and underground mining are the primary techniques used to recover this coal.

Surface or strip mining involves the removal of material, known as overburden, overlying a coal seam so as to expose the coal for recovery. In recent years, surface mining has gained prominence over underground mining in the United States. This is due to many factors including:

(a) the increased material moving capacity of surface or strip mining equipment;

(b) lower costs for surface mining than underground mining;

(c) the better safety record of surface mining versus underground mining;

(d) the higher coal recovery percentage for surface mining versus underground mining; and (e) the fact that geological factors favor extraction of many coal reserves by surface mining.

Surface mining does, however, have its limitations despite the advantages cited above. The primary limiting factor relates to the depth of the overburden. Once the coal seam reaches a certain depth below the surface, the amount of overburden that must be removed to reach the coal simply makes strip mining economically unfeasible.

When this occurs, large quantities of coal may still remain in the ground. Other mining methods must, however, be utilized if economic recovery of this coal is to be achieved. Underground mining application in such an instance is, typically, very limited. This may be due to a number of factors including the existence of poor roof support conditions, the thinness of the seam and/or the presence of insufficient quantities of coal to warrant the large capital investments characteristic of underground operations.

Due to these considerations, auger mining is often used to recover coal following a strip mining operation where the overburden becomes too costly to remove. A large auger is used to bore into the face of the seam and recover the coal from beneath the overburden. Advantageously, auger mining is very efficient providing more tons per man per day than any other form of mining. Auger mining may also be initiated quickly and requires a relatively low capital expenditure when compared to surface and underground mining. Auger mining has also been found to date to be the best method to use in relatively thin seams. Further, auger mining is safer than both surface and underground mining. Thus, auger mining may be used to effectively supplement a strip mining operation and recover small coal deposits that would otherwise be left behind.

Auger mining is, however, also not without its disadvantages. Auger mining provides a relatively low total coal recovery. Coal recovery for the resource area being augured is usually less than about 35%. Some of the lost recovery is due to the pillars of coal that are left standing to support the overburden between adjacent auger holes. The majority of the recovery shortfall, however, is due to the limited penetration depths achievable with auger mining equipment.

More particularly, as penetration depths increase, a greater number of auger flights are required to convey the coal from the cutting head to the seam face for recovery. Each flight adds to the frictional resistance to the turning of the auger through contact with the walls of the bore hole. Additionally, the longer the string of auger flights, the greater the weight of coal being moved by the flights at any one time. As a result, it should be appreciated that auger power requirements increase rapidly with the depth of auger penetration.

Due to the above considerations, holes drilled by conventional auguring equipment are usually only of a depth of 150' with 200' being rarely attainable. Of course, any increase in this figure is desirable as it would greatly improve the coal recovery rate from a resource area.

SUMMARY OF THE INVENTION

Accordingly, it is a primary object of the present invention to provide an improved apparatus and method for recovering aggregate material, such as coal from a seam, overcoming the above-described limitations and disadvantages of the prior art including conventional auger mining equipment.

Another object of the present invention is to provide an apparatus for winning aggregate material at an improved overall recovery rate.

A further object of the invention is to provide an apparatus and method for winning aggregate material in a more efficient manner.

Yet another object of the invention is to provide a method and apparatus for winning aggregate material allowing safe and efficient recovery of material to a greater depth from the high wall face.

Yet another object of the present invention is the provision of an apparatus and method for winning aggregate material particularly adapted for mining soft bottom mineral seams.

Still another object of the invention is to provide an apparatus for winning aggregate material of relatively simple construction that is inexpensive to produce. The apparatus is also relatively easy to operate requiring a minimum crew of as few as three-five people so as to reduce labor costs. It should also be appreciated that it is easy to train individuals to operate the apparatus.

Still an additional object of the invention is to provide an apparatus and method for winning aggregate material that is essentially self-guided and maintains a straight line mining path during operation.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved apparatus is provided for mining aggregate material from a seam. The apparatus includes a mining machine, such as a continuous miner. The mining machine includes a rotary cutter that may be raised up and lowered down to cut material from the seam as the mining machine is advanced into the face.

The apparatus also includes a conveyor for conveying the cut or won aggregate material from the mining machine for recovery. Preferably, the conveyor comprises individual conveyor units supported for movement relative to the mine floor on ground engaging wheels and connected together to form a train. Each conveyor unit includes a support frame and an inclined conveyor held in the support frame. The inclined conveyor has an input end for receiving aggregate material from the miner and/or a preceding conveyor unit and an output end for discharging aggregate material to the next conveyor unit. By adding conveyor units to the train, the conveyor may be extended so as to allow mining deep into the earth from either a high wall face or a trench dug into the ground in flat land areas.

The connection between the conveyor units is made by a semi-rigid coupling mechanism specially adapted to prevent the train from buckling or jack-knifing during advance into the seam while also providing the necessary angular displacement in a vertical plane to allow the train to follow the contours of the mine floor. More specifically, each conveyor unit includes a pair of spaced clevises at a first end and pair of spaced tongues at a second, opposite end. Adjacent conveyor units are connected together by receipt of the tongues of one unit in the cooperating clevises of the other unit.

In accordance with a further aspect of the invention, a transverse load bearing pin is fixed in each clevis. A slot in each tongue is adapted to receive the load bearing pin of the mating clevis. Once the tongue and clevis are fully engaged, a locking pin is inserted into an aperture in the tongue. The locking pin effectively captures the load bearing pin in the tongue and completes the connection. Preferably, the coupling mechanism provides minimum free play in the horizontal and vertical directions (approximately $\frac{1}{4}$ inch and 2 inches respectively) so as to prevent buckling of the conveyor train during operation. Angular displacement of substantially 19° about the longitudinal axis of the load bearing pin is, however, allowed. This allows the train to effectively follow changes in pitch in the mine floor. Further, the free play allows the conveyor units to be connected together more easily. More specifically, the tongues may be engaged in the clevises when the conveyor units are slightly misaligned. Then, as the tongues and clevises are threaded together the conveyor units are guided into proper alignment and the connection is completed.

The apparatus also includes a means of advancing the conveyor and miner into the seam as the aggregate material is being won. The advancer may take the form of a reciprocating drive assembly attached to a launch vehicle or a pusher unit, both described in greater detail below.

Advantageously, the utilization of the launch vehicle allows the conveyor train to be extended by the addition of a conveyor unit without interrupting the conveyance of aggregate material. Accordingly, productivity is maximized. Further, by avoiding the necessity of stopping the inclined conveyors of the train each time a unit is added, the conveyor motors are not repeatedly subjected to the strain of restarting under load to reinitiate operation. Hence, the individual conveyor units provide more reliable operation over a longer service life.

In order to utilize the launch vehicle, the bench may be undercut beneath the seam to be mined. The launch vehicle includes a support frame that holds a conveyor for receiving aggregate material from the end conveyor of the train of conveyor units. The launch vehicle conveyor deposits aggregate material onto a discharge conveyor that conveys the material to a delivery location such as the bed of a hauling vehicle. Additionally, the launch vehicle includes spaced guide tracks for receiving the ground engaging wheels of the conveyor units and tracks of the miner. The end conveyor unit of the train is supported on the guide tracks directly over the receiving conveyor of the launch vehicle at seam height. This allows the conveyor train to be advanced smoothly into the seam during coal winning operations as coal is delivered to the receiving conveyor of the launch vehicle from the inclined conveyor of the end conveyor unit.

The launch vehicle may be held in position on the bench during mining operations by means of a series of anchors such as steel pipes or stakes that are positioned in holes drilled into the bench. The launch vehicle also includes a powerful reciprocating drive assembly that is operatively connectable to the end conveyor unit of the conveyor train. Accordingly, by operation of the drive assembly the end conveyor unit, the other conveyor units in the train and the mining machine, which are all rigidly attached together, may be advanced into the seam as aggregate material is cut. The drive assembly is used in conjunction with the drive mechanism of the mining machine to aid the advance of the mining machine during the cutting of aggregate material. Accordingly, where soft bottom conditions prevent effective mining of coal with a continuous miner alone, the drive assembly serves to advance the miner and allows mining of the seam. In this way, the problem of "high centering" is avoided and soft bottom seams may be effectively mined where this was not possible in the past. Further, by avoiding tearing up the soft bottom, the amount of bottom material in the aggregate product is reduced. Accordingly, the present apparatus allows the recovery of cleaner coal.

Advantageously, the combined pushing and pulling of the conveyor train is made possible by the semi-rigid coupling mechanism. This mechanism is relatively rigid in the horizontal and vertical directions so as to prevent buckling or jack-knifing of the conveyor train. Accordingly, it is possible to apply significant pushing pressure while maintaining alignment and operation of the individual conveyor units. Similarly, the direction of operation or advance of the apparatus is also maintained. Additionally, the coupling allows for limited angular displacement in a vertical plane between adjacent conveyor units. This allows the train to follow changes in pitch or contour of the mine floor. Accordingly, the apparatus is able to maintain its proper position within the coal seam for more efficient mining of a cleaner product.

As the mining machine and conveyor train are advanced in the manner described by the cooperating drive systems of the launch vehicle and miner, a front end loader or other appropriate equipment is utilized to place a new conveyor unit on the launch vehicle with the ground engaging wheels of that conveyor unit received in the guide tracks. A space is left between the last conveyor unit of the conveyor train and the conveyor unit just positioned on the launch vehicle. This space allows won aggregate material to drop from the train directly onto the receiving conveyor upon which it is conveyed beneath the newly added conveyor unit for recovery. Thus, it should be appreciated that the recovery of aggregate material such as coal, is continuous, even when adding conveyor units to the train.

After positioning on the launch vehicle, the control and power lines of the conveyor drive motor for the new conveyor unit are then coupled to the control and power lines of the conveyor train to initiate operation. As the reciprocating drive assembly approaches its forward or advance limit, a feed carriage, driven by hydraulic cylinders or by other means such as a capstan at the rear of the launch vehicle is actuated to advance the new conveyor unit into engagement with the end unit of the conveyor train. The new conveyor unit is then attached to what was previously the end conveyor unit by means of the described semi-rigid coupling mechanism, thereby becoming the new end conveyor unit of the train. During the attachment, coal continues to be conveyed by the train for delivery on the receiving conveyor of the launch vehicle. From there the coal is delivered to the discharge conveyor that conveys the coal to a delivery location. The reciprocating drive assembly is recycled and the conveyor train and mining machine are then advanced into the seam in the manner previously described. This cycle is repeated as required.

In accordance with an alternative embodiment of the invention, the launch vehicle is replaced by a separate pusher unit. As with the launch vehicle described above, the pusher unit includes a receiving conveyor for receiving aggregate material from the conveyor train and a discharge conveyor for conveying aggregate material to a delivery location. The pusher unit is also self propelled. The pusher unit includes hydraulic jacks adapted to engage the couplers of the end conveyor unit of the train. The jacks are extended as the conveyor train and mining machine are advanced into the seam during cutting of aggregate material.

Once the jacks have advanced to their fullest extent, they are retracted as the self propelled pusher unit moves up toward the conveyor unit at the end of the conveyor train. The jacks are then reextended to advance the conveyor train and mining machine as already described. Once the jacks are fully extended, they are retracted as the pusher unit is again moved toward the end of the conveyor train. The cycle is repeated as necessary to advance the apparatus into the seam. Once the pusher unit approaches the high wall face, it is disconnected from the conveyor unit at the end of the train and moved backward away from the train by means of the self propulsion system. A new conveyor unit is then added and coupled to the train and the pusher unit brought back in position to engage that unit. The conveyor unit and miner are then advanced into the seam as described above with additional conveyor units added as necessary.

In either embodiment utilized, it eventually becomes necessary to withdraw the miner and the conveyor train from the seam and initiate a new cut at a spaced location along the high wall face. In the first embodiment, the reciprocating drive assembly is used in conjunction with the self propulsion system of the mining machine to withdraw the conveyor train, a conveyor unit at a time from the seam. In the second embodiment, the pusher unit is used in conjunction with the self propulsion system of the mining machine to withdraw the conveyor train a conveyor unit at a time. Once all the equipment has been withdrawn from the seam, the mining machine is moved to the new cut location spaced a sufficient distance from the previous location so as to leave a pillar of material in the seam sufficient to support the overlying strata. The mining machine is then advanced into the seam with conveyor units added as necessary in the manner previously described in order to continue the mining operation.

In accordance with another important aspect of the present invention, a method of continuously mining aggregate material from a seam utilizing a mining machine and conveyor is provided. The method includes the step of cutting the aggregate material from the seam, conveying the aggregate material cut from the seam to a recovery location and extending the conveyor without interrupting conveying of the aggregate material. This is accomplished utilizing the launch vehicle that supports both the end conveyor unit of the conveyor train and the new conveyor unit to be added to the train over a receiving conveyor. As indicated above, this system allows a significant increase in productivity by eliminating the delay created in backing up the pusher unit from the conveyor train so as to allow the addition of another conveyor unit.

Still other objects of the present invention will become readily apparent to those skilled in this art from the following description wherein there is shown and described a preferred embodiment of this invention simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention, and together with the description serves to explain the principles of the invention. In the drawing:

FIG. 4 is a side elevational view of a conveyor unit showing the inclined conveyor of the unit in phantom line;

Reference will now be made in detail to the present preferred embodiment of the invention, an example of which is illustrated in the accompanying drawings.

DETAILED DESCRIPTION OF THE INVENTION

Figure 1:
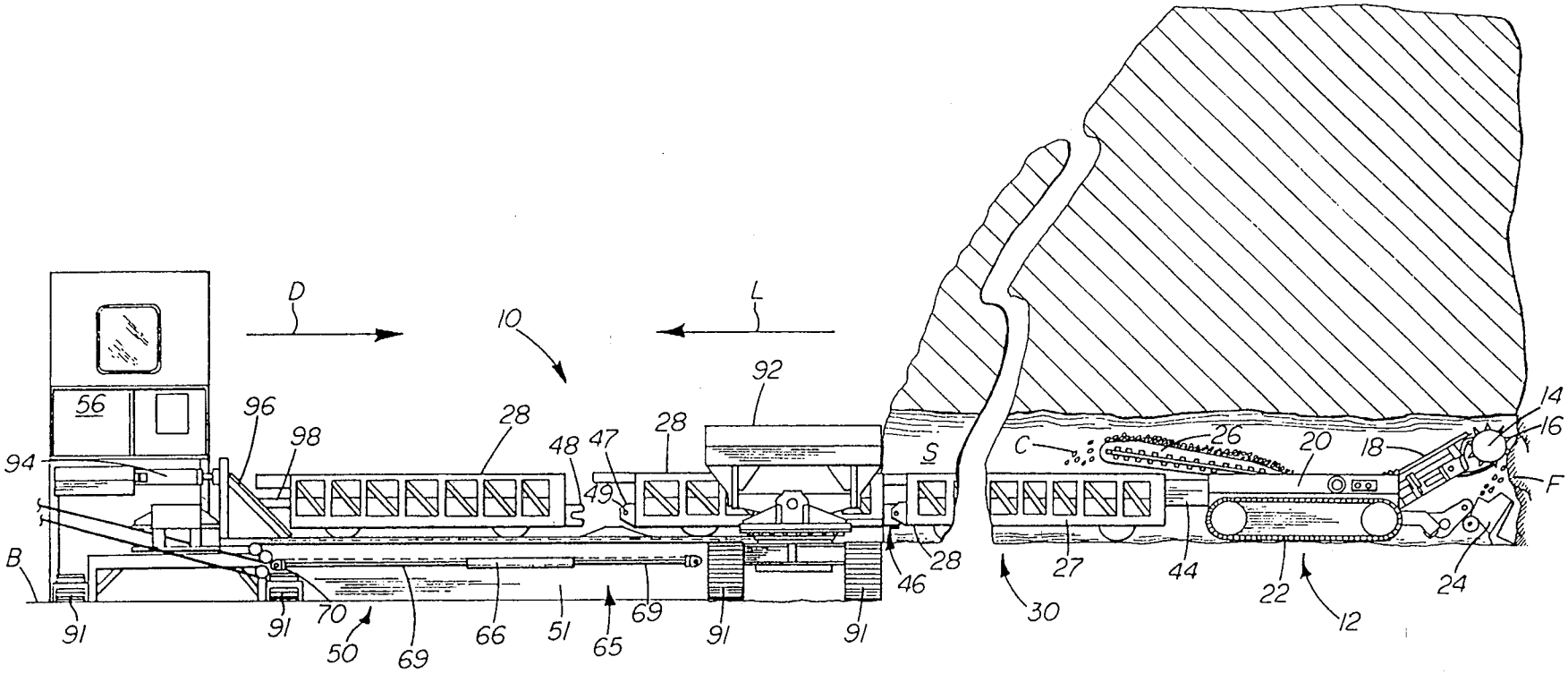
FIG. 1 is a partially sectional and side elevational view with near sidewall removed schematically showing the mining apparatus of the present invention including a mining machine, individual conveyor units for forming a conveyor train and a launch vehicle.

Reference is now made to FIG. 1 schematically showing the preferred embodiment of the apparatus for mining aggregate material from a seam. As shown, preferably the apparatus 10 includes a mining machine 12 of the continuous mining type as is known in the art. More particularly, the mining machine 12 includes a rotating cutter head drum 14 supporting a series of cutting bits 16 on helical flights (not shown). The cutter head drum 14 is rotatably mounted on a vertically movable boom 18 that is pivotally mounted on the main frame member 20 of the mining machine 12. As also shown, the main frame 20 is supported for movement along the floor of the mine by a pair of crawler assemblies 22 as is known in the art. Only one crawler assembly is shown in FIG. 1.

In operation, the mining machine 12 is preferably advanced into the face F of the coal seam S with the boom 18 raised and the cutter head drum 14 rotating. As the cutting begins at the top level or roof line of the seam S, the mining machine is advanced further forward and the boom 18 is gradually lowered. As the mining machine 12 is advanced and the boom 18 is raised and lowered, coal C is cut from the face F by the cutting bits 16. The aggregate coal C is then collected by means of a conventional gathering head 24 that serves to deliver the aggregate coal to the flight conveyor 26.

Figures 2, 3:
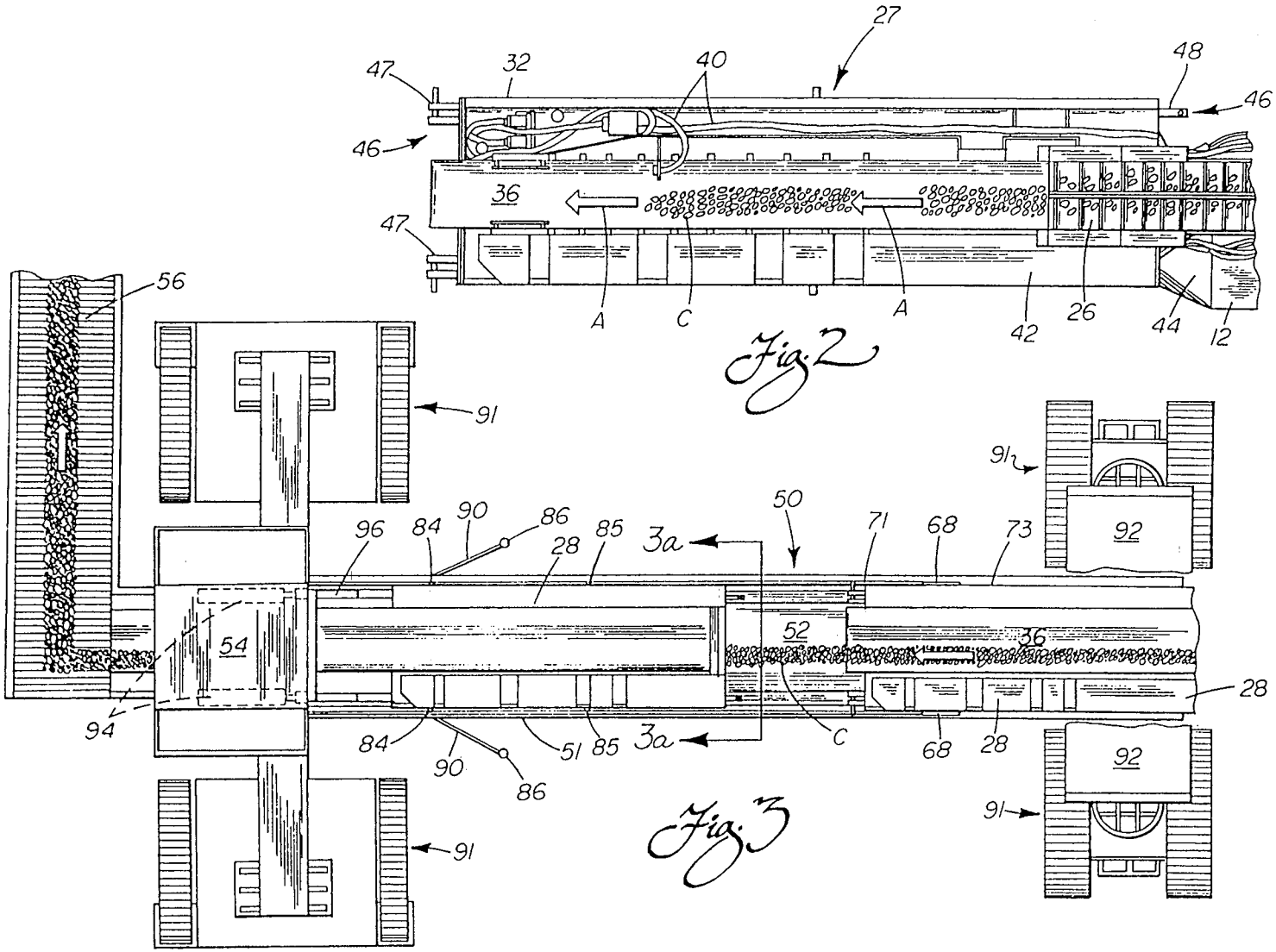
FIG. 2 is a top plan view of the lead conveyor unit of the conveyor train including a fragmentary showing of the tail end of the mining machine.
FIG. 3 is a top plan view of the launch vehicle showing a conveyor unit about to be added to the conveyor train (note: the forward crawler assembly and integral safety canopy are broken away to show the forward end of the launch vehicle and last conveyor unit of the conveyor train)

As shown, the flight conveyor 26 delivers the aggregate coal C to the lead conveyor unit 27 of a conveyor train generally designated by reference numeral 30 (see also FIG. 2). The lead conveyor unit 27 may be equipped with a series of cameras (not shown) to allow the operator to view the operation of the mining machine 12 from a remote location. The conveyor train 30 also comprises a series of conveyor units 28, identical to one another, that are releasably coupled together in series behind the lead conveyor unit 27.

As best shown in FIGS. 2 and 4, each conveyor unit 27, 28 comprises a main structural frame 32 supported for movement on ground engaging wheels 34. Each conveyor unit 27, 28 also includes a centrally disposed, longitudinally extending inclined conveyor 36. The conveyor 36, which is preferably of the belt type, operates so as to convey the aggregate coal C received at the low end to the high end where it is discharged from the conveyor unit. Accordingly, it should be appreciated that coal is conveyed along the conveyor 36 from right to left in FIGS. 2 and 4 as shown by the action arrows A.

Each conveyor unit also includes its own motor (not shown) for driving the conveyor 36. Further, all the conveyor units 27, 28 in the conveyor train 30 are interconnected by means of a control line 40 (see also FIG. 3*a*) that is first routed from a power source, such as a generator (not shown) on the bench B, to the mining machine 12 and then back through the individual conveyor units 27, 28. Accordingly, the motors of the individual conveyor units are connected in series for simultaneous operation at a substantially consistent speed. At the other side of the conveyor units 28 within the main frame 32, ductwork 42 is provided. This duct work may be connected with an exhaust duct 44 on the mining machine 12. A fan (not shown) in the lead conveyor unit 27 serves to draw dust and debris away from the face F through the duct work 42, 44 during mining operations in a manner known in the art.

Figure 7B:
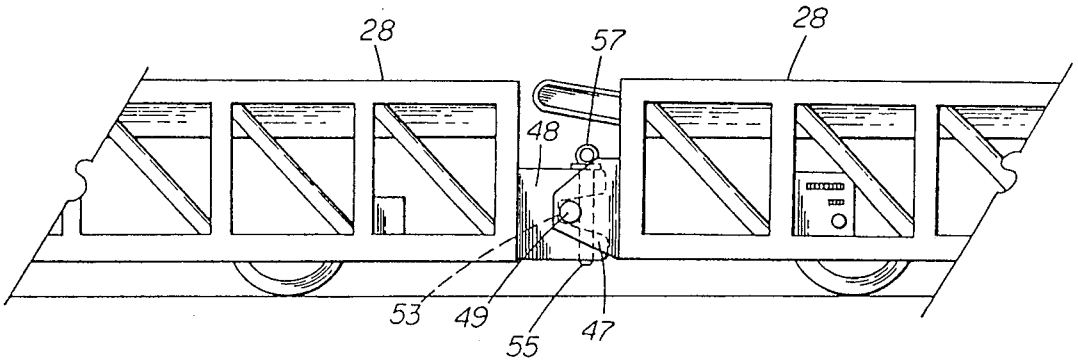
FIG. 7*b* is a detailed side elevational view showing the coupling between two conveyor units.
Figure 7A:
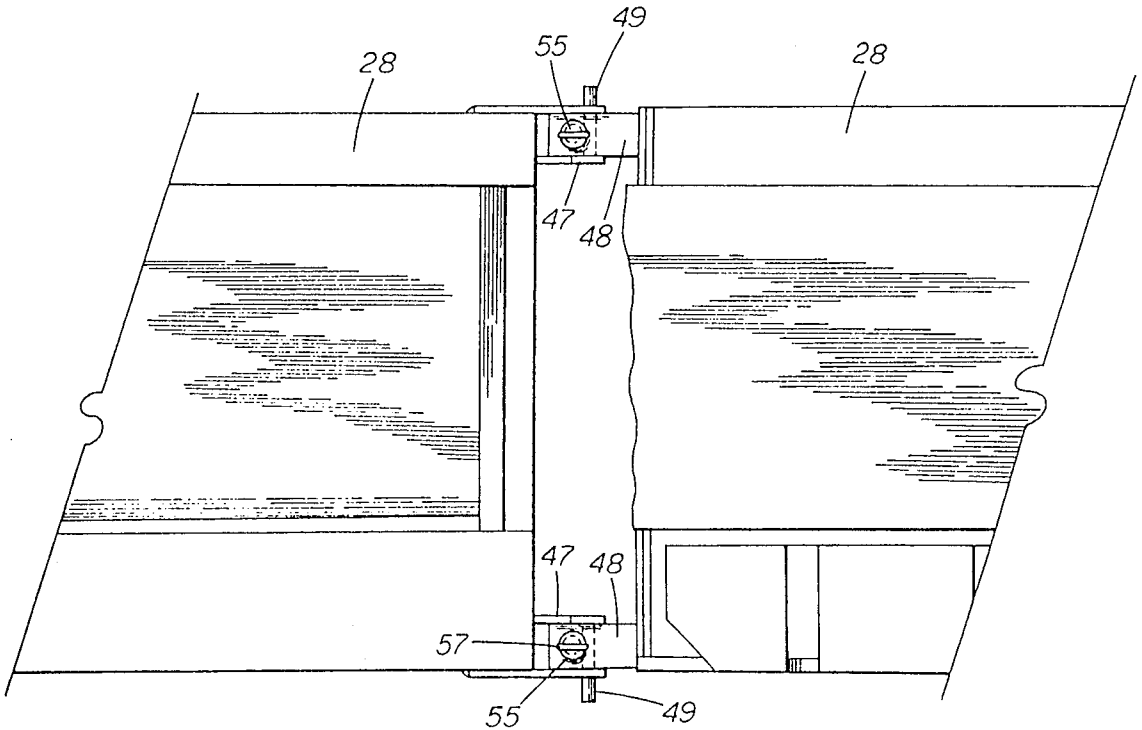
FIG. 7*a* is a detailed top plan view showing the coupling between two conveyor units.

Each of the conveyor units 28 also includes a coupling mechanism 46 specifically adapted to allow the conveyor units 27, 28 to be coupled together and the lead. conveyor unit 27 to be coupled to the mining machine 12. Preferably, a semi-rigid coupling mechanism 46 is provided; that is, a coupling mechanism that interconnects the conveyor units 27, 28 sufficiently rigidly to allow the train 30 to be pushed. The coupling mechanism 46 includes a pair of cooperating clevises 47, one at each corner of the trailing end of each conveyor unit 28 (see FIGS. 7*a* and 7*b*). A pair of mating, cooperating tongues 48 are provided at the leading end of each conveyor unit 28, one at each corner. As adjacent, in-line conveyor units 27, 28 are connected, the tongues 48 are received in the clevises 47; that is, between the plates forming the clevises. Each clevis 47 carries a permanent load bearing pin 49 that is simultaneously received within a slot 53 cut in the cooperating tongue 48. When the tongues 48 are fully received within the clevises 47, the pins 49 are butting against the bottom of the slots 53 in the tongues. A locking pin 55 is then inserted downwardly in an aperture in each tongue 48 so as to capture the load bearing pins 49 and complete the connection. Each locking pin 55 includes a pull ring 57 to allow ease of removal when necessary. Of course, an automatic hitch could be utilized in place of the locking pins 55.

Advantageously, the coupling mechanism 46 just described is specially designed to provide the necessary rigidity to allow pushing of the conveyor train 30 in the manner described below while also providing the necessary free angular movement to allow the conveyor train 30 to follow the contour of the mine floor or seam. More specifically, the coupling mechanism 46 provides for angular movement of approximately 19° about the longitudinal axis of the load bearing pin 49 so as to allow the individual conveyor units 28 of the train 30 to follow uphill and downhill contours or inclines. Horizontal and vertical play are, however, limited to ¼ inch and two inches respectively to prevent buckling or jackknifing of the train 30 during pushing. Such play does, however, simplify the conveyor unit connecting process. More particularly, the tongues 48 and clevises 47 of adjacent conveyor units 27, 28 may be slightly misaligned when initially engaged. As complete insertion is realized, the conveyor units 27, 28 are guided into full alignment and the pins 55 may be inserted to complete the connection process.

Accordingly, when connected together by means of the coupling mechanism 46, the conveyor units 27, 28 remain in substantially straight alignment behind the mining machine 12. Thus, the apparatus 10 of the present invention ensures that mining is completed in a straight line and, accordingly, any need for an expensive guidance system is also avoided. Additionally, operator controls are simplified.

As should be appreciated from viewing FIG. 1, the conveyor train 30 includes as many conveyor units 28 as are necessary to have the train extend out of the seam S to the bench B. As shown, preferably the bench B is undercut below the bottom of the seam so as to receive a launch vehicle or platform 50. The launch vehicle 50 includes a main framework 51 that supports a conveyor 52 for receiving aggregate coal C from the last conveyor unit 28 of the train 30. This coal C is delivered by the receiving conveyor 52 up an incline, beneath the operator control cab 54, to a discharge conveyor 56. The discharge conveyor 56 is also inclined and may, for example, be utilized to convey the aggregate coal C to a delivery location such as the bed of a truck which is used to haul the coal away for stockpiling or further processing.

Figure 3A:
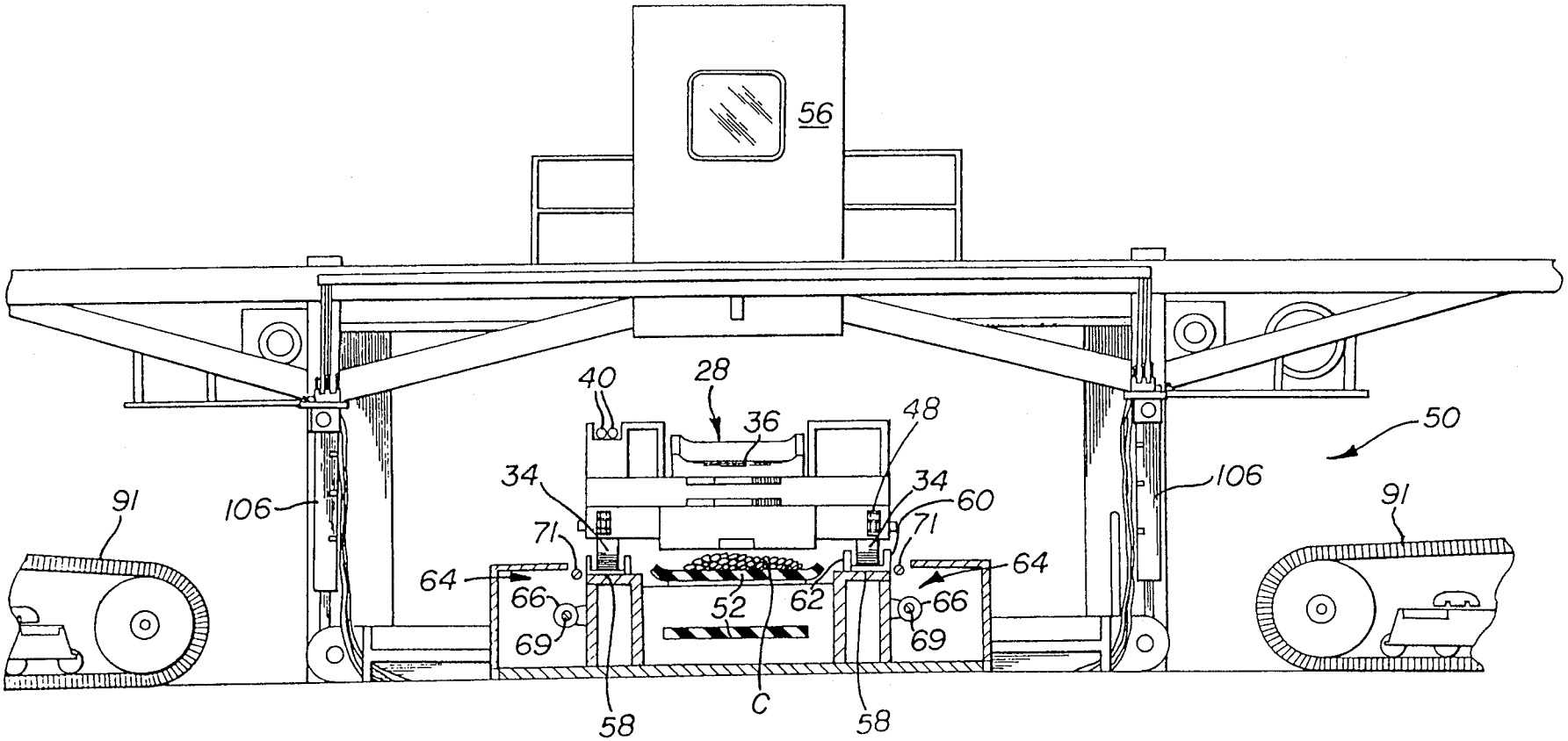
FIG. 3*a* is a cross-sectional view taken along line 3*a* of FIG. 3.
Figure 2:
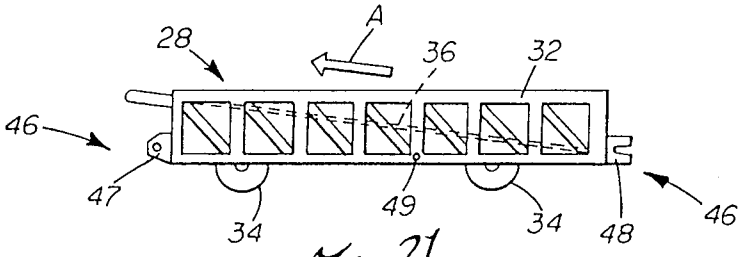

As best shown in FIGS. 3 and 3*a*, the launch vehicle 50 includes two spaced guide tracks 58 mounted at the top of the framework 51. One guide track 58 is provided at each side of the conveyor 52. As shown in FIG. 3*a*, the guide tracks 58 are spaced the proper distance so as to receive the ground engaging wheels 34 of any of the conveyor units 28. As shown, the guide tracks 58 include inner and outer sidewalls 60, 62 that engage the wheels 34. Accordingly, it should be appreciated that the spaced guide tracks 58 function as channels to effectively support and guide a conveyor unit 27, 28 received thereon. Additionally, it should be appreciated that by undercutting the bench beneath the floor of the seam, the guide tracks 58 are effectively provided at the level of the seam floor. Thus, the conveyor units 28 may be smoothly advanced into the seam in a substantially horizontal direction without any significant change in elevation.

In accordance with an important aspect of the present invention, the launch vehicle 50 also includes a reciprocating drive assembly generally designated by reference numeral 64. The drive assembly 64 comprises a pair of combined cylinder/cable drive systems 65, one at each side of the launch vehicle 50. As will become more apparent as the description hereof proceeds, the drive assembly 64 serves to actively push the conveyor train 30 and, in conjunction with the active pulling provided by the crawler assemblies 22 of the mining machine 12, functions to aid in the advance of the conveyor train and mining machine into the seam S.

Figure 3B:
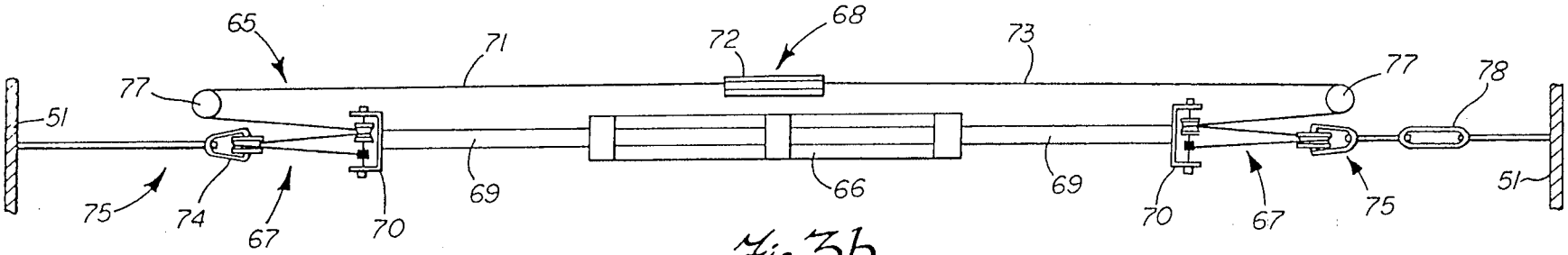
FIG. 3*b* is a schematical view of one drive system of the reciprocating drive assembly mounted to the launch vehicle.

As shown in FIG. 3*b*, each drive system 65 includes a double acting hydraulic cylinder 66 connected by means of a motion multiplying cable drive linkage 67 to a captive hook unit 68. The double acting hydraulic cylinder 66 includes a pair of opposed, cooperating piston rods 69. The distal end of each rod 69 includes a clevis 70. A first cable 71 has a first end mounted to one clevis 70 and a second end mounted to the base 72 of the captive hook unit 68. A second cable 73 has a first end mounted to the other clevis 70 and a second end mounted to the opposite end of the base 72 of the captive hook unit 68. Each cable 71, 73 extends from the associated clevis 70 and is reeved around the idler roller 74 of a block and tackle 75, a second idler roller 76 mounted to the associated clevis 70 and a third idle roller 77 mounted to the launch vehicle 50. Accordingly, three cable strands are provided at each end of the hydraulic cylinder 66. These strands serve to multiply the motion of the cylinder 66 relative to the captive hook unit 68 at a three-to-one ratio. Hence, a cylinder 66 providing a total range of motion of fifteen feet serves to move the captive hook unit 68 over a forty-five foot range. A turnbuckle 78 may be provided to maintain the proper cable tension.

Figure 3D:
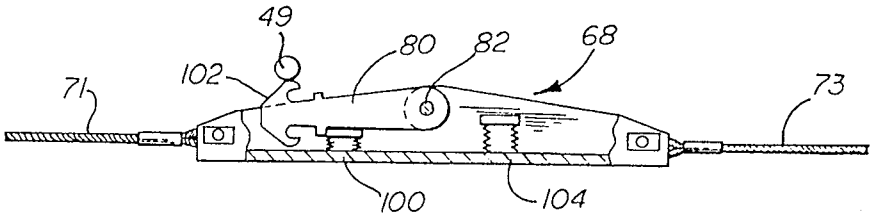
FIG. 3*d* is a partially broken away, detailed side elevational, schematical view of the captive hook unit showing the hook unit pivoted down and passing under a pin on a conveyor unit.
Figure 3C:
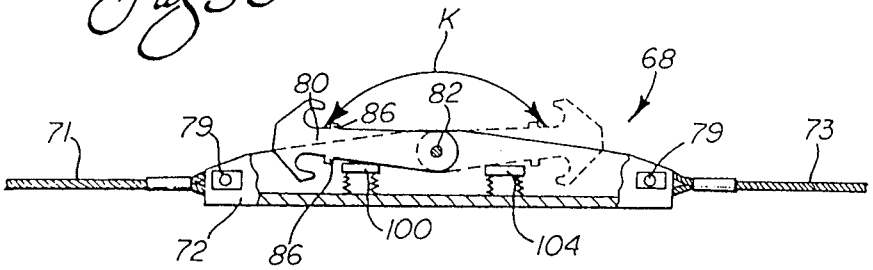
FIG. 3*c* is a partially broken away, detailed side elevational view of the captive hook unit adapted to connect a reciprocating drive assembly to an individual conveyor unit.

Each cylinder-cable drive system 65 is operatively connected to a conveyor unit 28 of the conveyor train 30 by means of the captive hook unit 68. More specifically, each captive hook unit 68 includes a base 72 having opposing ends connected by pins 79 or other means to the two cables 71, 73 of the drive linkage 67 as shown in FIGS. 3*b*, 3*c* and described above. A double hook 80 is pivotally mounted to the base 72 by means of a pin 82. As described in greater detail below, the double hook 80 may be selectively positioned in a first position (shown in full line) for engaging a cooperating pin 49 on the coupling mechanism 46 between the conveyor units 28 and advancing the conveyor train 30 into the coal seam. Alternatively, the double hook 80 may be selectively positioned in a second, opposite position (shown in phantom line) for engaging a pin 49 on the opposite side and withdrawing the conveyor train 30 from the coal seam. The double hook 80 also includes a pair of detents 86 for holding the hook on the pin 49 of the conveyor unit 28 even when some slack exists in the cable drive linkage 67.

Advantageously, the drive assembly 64 is sufficiently powerful to aid in advancing the conveyor train 30 and mining machine 12 into the face F. This is a particularly important advantage as in many mining areas soft bottom conditions, such as fire clay, exist. The crawler assemblies 22 on a conventional mining machine 12 dig ruts in the soft bottom until the main frame 20 of the miner "high centers" and comes to rest on the undisturbed bottom material between the ruts. Accordingly, continuous miners have a propensity to become stuck where soft bottom conditions are present. Accordingly, mining of these seams was avoided in the past. With the present system, mining of these seams is now possible. Thus, the present apparatus effectively opens up new areas for mining thereby increasing recoverable coal reserves.

In order to ensure that the launch vehicle 50 remains stationary as the drive assembly 64 is operated to aid in the advance of the conveyor train 30 and continuous miner 12, the launch vehicle may be anchored to the bench B. This can be achieved in any manner known in the art. One approach is shown in FIGS. 1 and 3. More particularly, a series of holes are predrilled down into the bench. Six inch diameter steel pipes 86 are then extended down into the holes drilled in the bench B. A taut steel cable 90 is then attached between each pipe 86 and the launch vehicle 50. Together, the cables 90 and pipes 86 serve to effectively hold the launch vehicle 50 in position during operation of the drive assembly 64.

Operation of the preferred embodiment of the present invention will now be described in detail. Following the completion of surface mining, the bench B is prepared with a bulldozer and/or other heavy equipment by undercutting below the bottom of the seam S a sufficient distance for the proper positioning of the launch vehicle 50, if possible. The launch vehicle 50 may be supported on and moved into position by means of crawler assemblies 91. As should be appreciated, four sets of crawler assemblies 91 are provided at each end of the launch vehicle 50 shown in FIGS. 1 and 3. An engineer's transit may be utilized to insure the proper alignment of the launch vehicle 50 relative to the seam to be mined. Since the conveyor unit 27 and mining machine 12 are semi-rigidly connected together as, for example, by a coupling mechanism 46 of the type described above, the apparatus 10 stays substantially on line during mining.

Once in position, the frame 51 of the launch vehicle 50 is lowered on jacks 106 so as to rest on the ground. When so positioned the guide tracks 58 of the launch vehicle 50 are substantially level with the floor of the seam S. Once the launch vehicle 50 is positioned near the high wall face H at the point of the seam S to be mined, the integral safety canopy 92 that extends over the forward crawler assembly 91 is positioned adjacent the high wall face. An additional safety canopy (not shown) as is known in the art may also be used, if desired, between the crawler assembly 91 and the high wall face where the assembly is not or cannot be positioned directly adjacent the high wall. Next, anchoring holes are drilled in the bench B as described above and pipes 86 are extended down into the holes. Cables 90 are then used to secure the launch vehicle 50 to the pipes 86 thereby anchoring the launch vehicle in position.

The mining machine 12 and lead conveyor unit 27 may be positioned on the launch vehicle 50 prior to moving the launch vehicle into position on the bench B. With the crawler assemblies 22 of the mining machine 12 aligned with and resting in the guide tracks 58, the boom 18 is raised to align the cutter head drum 14 with the top of the seam S. The cutter head drum 14, gathering head 24 and flight conveyor 26 are then activated. Next, the crawler assemblies 22 are engaged to advance the mining machine 12 toward the face and into the seam S. The mining machine 12 is operated in a manner known in the art from the operator cab 54 to win aggregate coal C from the seam S. As the mining machine 12 is being advanced into the seam S, the lead conveyor unit 27 follows along the guide tracks 58.

Once the miner 12 is sufficiently advanced into the seam S to provide clearance on the launch vehicle 50, a conveyor unit 28 is positioned on the launch vehicle 50 with a front end loader 93 so that the wheels of the conveyor unit 34 are received in the spaced guide tracks 58. The control line 40 to the new conveyor unit 28 is connected to the control line 40 of the lead conveyor unit 27. This initiates operation of the conveyor 36 on the conveyor unit 28. Next, dual, cooperating drive cylinders 94 are activated to advance a feed carriage 96 at the rear of the launch vehicle 50. The feed carriage 96 rides along a track in the frame 51 and includes bumpers 98 that engage the rear of the new conveyor unit 28. Accordingly, as the feed carriage 96 is advanced in the direction of action arrows D, the new conveyor unit 28 is driven toward the rear of the lead conveyor 27 until the two units engage and may be coupled together by means of the mechanism 46. The drive cylinders 94 are then recycled to the retracted position to return the feed carriage 96 to the end of the launch vehicle 50. It should be appreciated that throughout this operation, aggregate coal is being conveyed continuously for recovery.

More particularly, as the first conveyor unit 28 is being positioned on the launch vehicle 50, aggregate coal cut from the seam S by the cutter head drum 14 is passed by the gathering head 24 to the flight conveyor 26 of the mining machine and the inclined conveyor 36 of the lead conveyor unit 27. The coal C is then delivered to the receiving conveyor 52 of the launch vehicle 50. The receiving conveyor 52 conveys the aggregate coal under the new conveyor unit 28 to the discharge conveyor 56. The discharge conveyor 56 conveys the coal C to a delivery location such as the bed of a coal truck (not shown) for haulage to a stockpile or for further processing.

As the new conveyor unit 28 is advanced toward the mining machine 12 by the feed carriage 96, the receiving end of the conveyor 36 begins to intercept the coal being discharged by the conveyor 36 of the lead conveyor unit 27. As previously described, the conveyor 36 on the unit 28 is already operating when this occurs. Accordingly, the coal is conveyed along the conveyor 36 to the discharge end where it is still delivered to the receiving conveyor 52 of the launch vehicle 50. From there the aggregate coal C is conveyed to the delivery location as described above.

Once the conveyor unit 28 is advanced into position behind the lead conveyor unit 27 with the tongues 48 fully received in the clevises 47, the locking pins 55 are inserted into position in the tongues so as to capture the load bearing pins 49. The first conveyor unit 28 is then semi-rigidly coupled to the lead conveyor unit 27. Next, the reciprocating drive assembly 64 is connected to the conveyor unit 28. More particularly, the hooks 80 of the drive systems 65 on each side of the launch vehicle 50 are connected to the pins 49 at the rear of the new conveyor unit 28. These pins 49 project sufficiently to allow connection (see also FIG. 7*a*). The drive systems 65 are then operated synchronously and in tandem to aid in the advance of the conveyor train 30 and mining machine 12 into the face F of the seam S.

More specifically, the cylinders 66 are actuated to drive both captive hook units 68 together toward the seam face F (note action arrow D in FIG. 1). Through the connection of the captive hook units 68 to the conveyor unit 28 by engagement of the hooks 80 and pins 49, this movement serves to drive the train 30 and mining machine 12 into the seam face F from which coal is cut by the cutter head drum 14. The advancing of the conveyor train 30 and mining machine 12 into the seam face F continues until the cylinders 66 and hence the captive hook units 68 begin to approach their forward movement limit. At that time sufficient clearance exists on the launch vehicle 50 for placement of the next conveyor unit 28 to be attached to the conveyor train 30. Thus, as the conveyor unit 28 approaches the forward end of the launch vehicle 50, the front end loader 93 is utilized to position the next conveyor unit 28 on the launch vehicle with the wheels 34 received in the guide tracks 58. The control line 40 to the new conveyor unit 28 is connected to the control line 40 of the end conveyor unit of the train 30 so as to initiate operation of the new conveyor 36. Next, the drive cylinders 94 are actuated to advance the feed carriage 98 and thereby drive the new conveyor unit 28 into what was previously the end unit of the conveyor train 30. The new conveyor unit 28 is then coupled to the train 30 (in the manner previously described) and the drive cylinders 94 recycled to return the feed carriage to the retracted, home position.

Once the new conveyor 28 is connected to the train 30, the drive assembly 64 is recycled. As a result, the hooks 80 are released from the pins 49 of what was previously the end unit of the conveyor train 30. The captive hook units 68 are both driven together (in the direction of arrow L as shown in FIG. 1) until they are brought into operative engagement with the pins 49 of the newly added conveyor unit 28.

It should be appreciated that the hooks 80 spring down under the pins 49 as they move in the direction of action arrow L so as to allow passage. More specifically, each hook 80 rests upon a spring loaded stop 100. Accordingly, when the curved lead face 102 engages a pin 49, the hook is cammed downwardly against the spring loaded stop 100 (see dashed line position shown in FIG. 3*d*) to allow passage of the hook 80 under the pin. In contrast, when moved in the opposite direction, the pin 49 is captured in the hook 80 and held in place by the detent.

Once the hooks 80 are engaged with the pins 49 of the new conveyor unit 28, the train 30 and mining machine 12 are advanced into the seam in the manner already described. Once again, it should be appreciated that throughout this operation, coal is being conveyed without interruption.

More specifically, prior to coupling, coal from the conveyor 36 on the first unit 28 is discharged directly onto the receiving conveyor 52 of the launch vehicle 50 which then conveys the coal under the unit being added. As the unit being added is advanced towards the first unit, the conveyor 36 on the unit being added intercepts the coal. The coal is then conveyed by the conveyor 36 on the second unit 28 from which it is also discharged onto the receiving conveyor 52 of the launch vehicle 50. Accordingly, it should be appreciated that the present invention advantageously allows the conveyance of aggregate material and the mining of coal substantially without interruption even when a conveyor unit 28 is being added to the conveyor train 30.

Of course, it should be appreciated that additional conveyor units 28 may be added to the train 30 in the manner described above as required to mine the coal from the seam S to the desired depth. Once the maximum depth is reached, the conveyor train 30 and mining machine 12 are backed out from the seam. This process is done a conveyor unit 28 at a time.

More particularly, the hooks 80 of the captive hook units 68 are disengaged from the cooperating pins 49 of the conveyor unit 28 resting on the launch vehicle 50. The hooks 80 are then pivoted over to the dashed line position shown in FIG. 3*c* (note action arrow K) and then brought into engagement with the sides of the pins 49 nearest the coal seam face F. The reciprocating drive assembly 64 is then utilized in conjunction with the crawler assemblies 22 of the mining machine 12 to back the conveyor train 30 from the seam S. More specifically, the cylinders 66 are actuated to draw the captive hook units 68 through the cables 71, 73 toward the operator cab 54 on the launch vehicle 50. Once a conveyor unit 28 is positioned on the launch vehicle 50 out from underneath the safety canopy 92, the coupling mechanism 46 between this tail conveyor unit 28 and the remainder of the conveyor train 30 is then disconnected. That is done by pulling on the rings 57 and removing the locking pins 55. The control lines 40 to this last unit are also disconnected. A front end loader 93 or other heavy machinery is then utilized to lift the disconnected conveyor unit 28 from the launch vehicle 50. The drive assembly 64 is then recycled to bring the captive hook units 68 back to the front of the launch vehicle 50. As this is done, the hooks 80 are cammed down against the spring loaded stop 104 so as to pass under the pins 49 on the new end conveyor unit 28. Once past the pins 49, drawing back of the captive hook units 68 causes the hooks 80 to engage and capture the pins. Accordingly, the drive assembly 64 may again be used in conjunction with the crawler assemblies 22 of the mining machine 12 to back the conveyor train 30 and mining machine 12 from the seam in the manner prescribed.

The procedure is repeated for removing conveyor units 28 from the train one at a time. After the last conveyor unit 28 is removed, the mining machine 12 and lead conveyor unit 27 are backed onto the launch vehicle 50 with the crawler assemblies 22 engaging the guide tracks 58. The anchoring cables 90 are disconnected from the launch vehicle 50 and the anchoring pipes 86 are then removed from the bench B. The launch vehicle frame 51 is then raised from the bench B by means of jacks 106 and moved transversely across the bench B to the next mining location by means of the crawler assemblies 91. That mining location is a sufficient distance from the previous mining location so as to leave a pillar of material in the seam for support of the overlying strata. Alternatively, the launch vehicle 50 may be supported on skids. When this is done, a bulldozer or other piece of heavy equipment may be utilized to push the launch vehicle 50 along the bench B to the new mining location. Once positioned, the launch vehicle frame 51 is lowered by the jacks 106 into engagement with the bench B. Then the anchoring pipes 86 are reset in holes drilled in the bench and the cables 90 are connected between the launch vehicle 50 and the pipes 86. The mining operation then proceeds in the manner described above.

Figure 5:
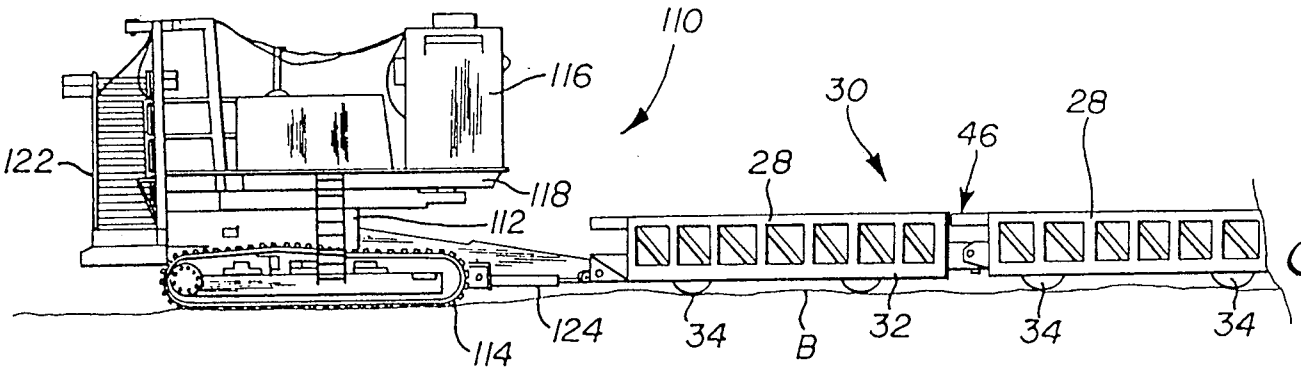
FIG. 5 is a side elevational view of an alternative embodiment of the present invention including a pusher unit.
Figure 6:
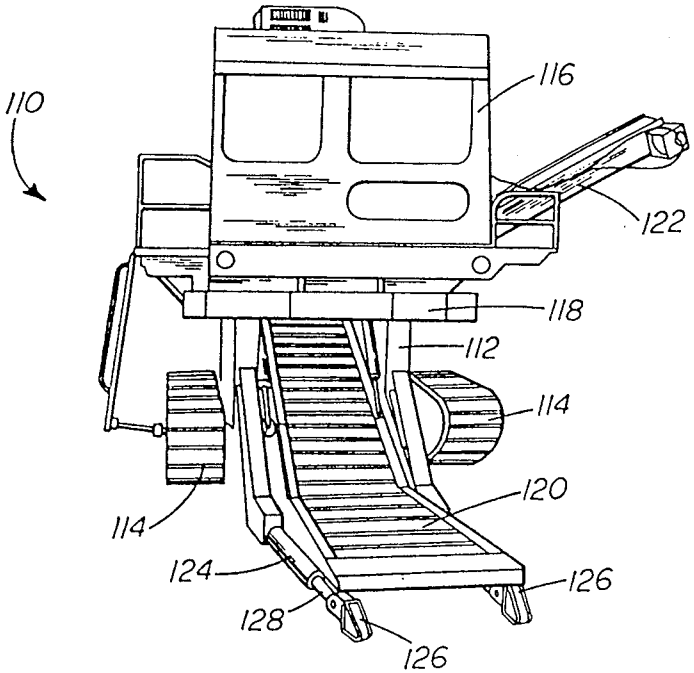
FIG. 6 is a front perspective view of the pusher unit.
Figure 1A:
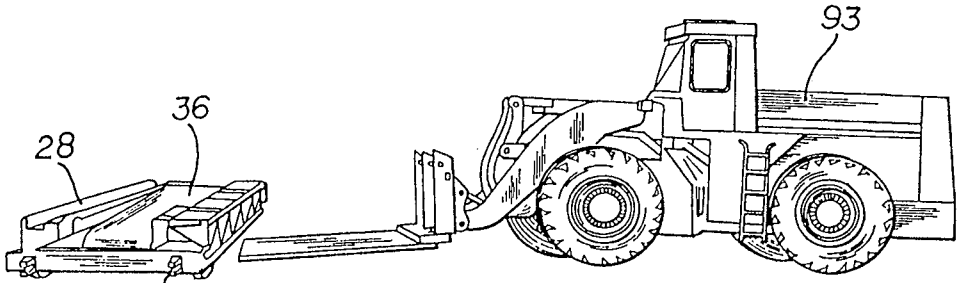
FIG. 1*a* is a perspective, schematical view of the loader used to position a new conveyor unit on the launch vehicle.

An alternative embodiment of the present invention is shown in FIGS. 5 and 6. In the alternative embodiment, the launch vehicle 50 is replaced with a pusher unit 110. The mining machine 12 and conveyor units 27, 28 forming a conveyor train 30 remain unchanged.

The pusher unit 110 includes a main frame 112 supported on a pair of crawler assemblies 114 (only one shown in FIG. 5). The crawler assemblies 114 are driven by a motor and transmission (not shown) so that the pusher unit 110 is self propelled. A cab 116 is mounted to a platform 118 mounted on the main frame 112. The cab 116 houses the controls for the operation of the apparatus 10. More particularly, these controls include video monitors connected to cameras mounted to the lead conveyor unit 27 or the mining machine 12 that allow the operator to view the mining taking place at the face of the seam S. Remote controls, as are known in the art, are also provided for the operation of the mining machine 12. Further, controls are provided for the operation of the pusher 110.

As shown in FIG. 6, the pusher 110 also includes a receiving conveyor 120 between the crawler assemblies 114 and beneath the platform 118. When the pusher unit 110 is positioned so as to engage the last unit 28 of the conveyor train 30, aggregate coal discharged from that unit is received on the conveyor 120. That coal is then conveyed rearwardly beneath the platform 118 to an inclined discharge conveyor 122 mounted to the rear of the pusher unit. This discharge conveyor 122 conveys the coal to a delivery location.

As also shown in FIGS. 5 and 6, the pusher unit 110 includes a pair of jacks 124. The hydraulic jacks 124 support a bumper member 126 at the distal ends of the extension rods 128 that are reciprocal in-and-out of the jacks 124. As should be appreciated, the bumper members 126 each incorporate a coupling mechanism 46 of the type described above.

As shown in FIG. 5, when the pusher unit 110 is properly positioned behind the conveyor train 30, the bumper member 126 engages the clevises 47 at the rear of the frame 32 of the end conveyor unit 28. Accordingly, it should be appreciated that the jacks 124 may be extended to push the conveyor train 30 forward and advance the conveyor train and mining machine 12 together into the seam S during the mining of the coal.

The operation of the alternative embodiment of the present invention will now be described. With this embodiment, the bench B is prepared so as to be level with the bottom or floor of the seam S. The mining machine 12 and lead conveyor unit 27 are then positioned and advanced as is known in the art to initiate the cutting of a path through the seam S. As is known in the art, a safety canopy is utilized adjacent the high wall face. For added safety, the mining machine 12 is remotely operated from a safe distance.

After initiation of the cut into the seam S, a conveyor unit 28 is positioned by means of a front end loader 93 or other appropriate equipment directly behind the lead conveyor unit 27 and mining machine 12. A coupling between the unit 28 and the lead conveyor unit 27 is then made in the manner already described. The pusher unit 110 is then advanced by means of the crawler assemblies 114 so as to be positioned directly behind the conveyor unit 28. When this maneuver is being completed, it should be recognized that the jacks 124 are fully retracted. The pusher unit 110 is carefully moved forward by operation of the crawler assemblies 114 until the bumper 126 engages the clevises 47 or load bearing pins 49 on the frame 32 of the conveyor unit 28. At that time, the crawler assemblies 114 are disengaged and the pusher unit 110 is anchored in position.

Next, the jacks 124 are extended to aid the crawler assemblies 22 in driving the conveyor unit 28 and mining machine 12 forward into the seam S. The jacks 124 provide an even force at both sides of the conveyor unit 28 thereby insuring that the mining machine 12 and conveyor train 30 advance straight into the seam S. Accordingly, efficient mining of soft bottom seams is possible while substantially avoiding the high center problem discussed above.

As the mining machine 12 and conveyor unit 28 are advanced into the seam S, coal is cut by the rotating cutter drum 14 and delivered by means of the gathering head 24, mining machine flight conveyor 26 and conveyors 36 of the units 27, 28 to the receiving conveyor 120 of the pusher unit 110. From the receiving conveyor 120, the aggregate coal is discharged onto the discharge conveyor 122 that then conveys the coal to its delivery location. The delivery location may comprise any number of possibilities including another conveyor for delivery of the coal to a stockpile or, for example, a bed of a truck for hauling the coal away from the bench to another location.

once the jacks 124 are fully extended, they are recycled to the fully retracted position and the pusher unit 110 is again advanced utilizing the crawler assemblies 114 until the bumper member 126 again engages the frame 32 of the conveyor unit 28. This operating cycle is then repeated to continue the mining of coal as many times as necessary until the pusher unit 110 approaches the safety canopy. At that time, the "inch worm" type of advance is terminated and the pusher unit 110 is disengaged from unit 28 and the crawler assemblies 114 are engaged to reverse the pusher unit 110 away from the conveyor unit. A front end loader 93 or other equipment is then operated to position another conveyor unit 28 behind the last conveyor unit 28 of the train 30. The two conveyor units 28 are then coupled together and the pusher unit 110 is again advanced into position with the jacks 124 fully retracted so as to bring the bumper member 126 into engagement with the rear of the unit 28 at the end of the conveyor train 30. The jacks 124 and crawler assemblies 114 are then again operated in the manner described above to advance the mining machine 12 and conveyor train 30 in inch worm fashion into the coal seam S.

This procedure is continued until the desired or maximum depth for mining is reached. At that point, the conveyor train 30 is withdrawn from the seam S one unit 28 at a time by connecting the bumper members 126 to the load bearing pins 49 of the clevises 47 and through operation of the crawler assemblies 114, 22 on the pusher unit 110 and the continuous miner 12. After successive removal of the conveyor units 28 from the train 30, the mining machine 12 and lead conveyor 27 eventually reemerges from the seam S. Mining is then re-initiated in the manner described above at a new point along the bench B spaced from the previous point a sufficient distance to maintain a pillar of coal sufficiently wide to support the strata over the seam.

In summary, numerous benefits result from employing the concepts of the present invention. The mining apparatus 10 is relatively simple to control and requires only a small crew (3 to 4) to mine up to the full capacity of the continuous miner 12. The conveyor units 27, 28 are relatively low in profile to allow mining of relatively narrow seams S. It should also be appreciated that the conveyor units 28 that make up the conveyor train 30 are all built exactly the same. Accordingly, they are completely interchangeable. Therefore, if one of the units should have an operational failure for any reason, it may be removed from the system and mining can continue without significant down time.

Advantageously, it should also be appreciated that the present system in either the preferred or alternative embodiments shown, provides a system for advancing or withdrawing the mining machine 12 and conveyor train 30 into or out of the seam S from the bench B. Accordingly, the crawler assemblies 22 of the mining machine 12 are not the only means to propel the mining machine into or from the face F. This is a major advantage in areas with soft bottom material such as fire clay. In fact, the present system allows efficient mining of such areas which was not truly possible in the past. Further, since this is achieved without tearing up the seam floor, the recovered product is not contaminated with bottom material.

The foregoing description of a preferred and alternative embodiments of the invention has been presented for purposes of illustration and description. It is not intended to be exhaustive or to limit the invention to the precise form disclosed. Obvious modifications or variations are possible in light of the above teachings.

For example, where the bench cannot be undercut, the launch vehicle 50 may simply be positioned on the bench B and the conveyor units 28 may be directed down a slight incline into the coal seam S. If necessary, the mining machine 12 may remove a portion of the roof material at the high wall face to provide sufficient clearance for the passage of the mining machine and conveyor units. Further, it should be appreciated that the present mining system may be used to mine coal seams in flat land areas. More specifically, a trench may be cut into the ground with the apparatus operated from the trench to remove coal from under the otherwise undisturbed overburden. As a further example, the launch vehicle 50 need not incorporate an operator cab. Operator controls can be remotely located.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. An apparatus for mining aggregate material from a seam, comprising:

mining means for winning aggregate material from the seam;

means for conveying won aggregate material from said mining means for recovery, said means for conveying being coupled to said mining means so as to follow said mining means into said seam; and means for advancing said conveying means with said mining means into said seam as said aggregate material is being won without interrupting the flow of aggregate material, said advancing means including separate active pulling means and active pushing means.

2. The apparatus set forth in claim 1, wherein said conveying means includes individual conveyor units connected together to form a train.

3. The apparatus set forth in claim 2, wherein each conveyor unit includes a support frame and an inclined conveyor held in said support frame, said inclined conveyor including an input end for receiving aggregate material and an output end for discharging aggregate material.

4. The apparatus set forth in claim 2, further including launching means for adding said individual conveyor units to form said train, said launching means including a conveyor arranged to remain in continuous conveying communication with a trailing end of said train during the addition of said individual conveyor units, for avoiding an interruption in the flow of aggregate material as each individual conveyor unit is being added.

5. The apparatus set forth in claim 1, further including a launch vehicle adapted to receive aggregate material from said conveying means, said launch vehicle remaining stationary as said mining means and conveying means are advanced into the seam during mining.

6. The apparatus set forth in claim 5, wherein said launch vehicle includes means for anchoring said launch vehicle to the ground.

7. The apparatus set forth in claim 5, wherein said conveying means includes individual conveyor units connected together to form a train, each unit supported for movement on ground engaging means.

8. The apparatus set forth in claim 7, wherein said launch vehicle includes a receiving conveyor and means for supporting and guiding a conveyor unit at an end of said train above said receiving conveyor so that aggregate material discharged from said end conveyor unit is received on said receiving conveyor.

9. The apparatus set forth in claim 8, wherein said supporting and guiding means are a pair of spaced channel rails for receiving the ground engaging means of said conveyor units.

10. The apparatus set forth in claim 8, further including means for positioning an additional conveyor unit on said launch vehicle as said mining means and conveying means are advanced into the seam.

11. The apparatus set forth in claim 8, wherein said launch vehicle includes a discharge conveyor fed by said receiving conveyor, said discharge conveyor feeding aggregate material to a delivery location.

12. An apparatus for mining aggregate material from a seam, comprising:

mining means for winning aggregate material from the seam;

means for conveying won aggregate material from said mining means for recovery, said conveying means including individual conveyor units supported for relative movement with respect to an underlying mine floor;

means for coupling said individual conveyor units together to form a train, said coupling means being sufficiently rigid to prevent buckling of said units during pushing while also allowing angular displacement to accommodate changes in the pitch of the mine floor; and means for actively pushing said conveying means with said mining means into the seam as aggregate material is being won without interrupting the flow of aggregate material.

13. The apparatus set forth in claim 12, wherein each conveyor unit includes a support frame and an inclined conveyor held in said support frame, said inclined conveyor including an input end for receiving aggregate material and an output end for discharging aggregate material.

14. The apparatus set forth in claim 12, further including a launch vehicle adapted to receive aggregate material from said conveying means, said launch vehicle remaining stationary as said mining means and conveying means are advanced into the seam during mining.

15. The apparatus set forth in claim 14, wherein said pushing means is a reciprocating drive assembly mounted to said launch vehicle.

16. The apparatus set forth in claim 14, wherein said launch vehicle includes means for anchoring said launch vehicle to the ground.

17. The apparatus set forth in claim 14, wherein said launch vehicle includes a receiving conveyor and means for supporting and guiding a conveyor unit at an end of said train above said receiving conveyor so that aggregate material discharged from said end conveyor unit is received on said receiving conveyor.

18. The apparatus set forth in claim 17, wherein said supporting and guiding means are a pair of spaced channel rails for receiving the ground engaging means of said conveyor units.

19. The apparatus set forth in claim 17, further including means for positioning an additional conveyor unit on said launch vehicle as said mining means and conveying means are advanced into the seam.

20. The apparatus set forth in claim 19, wherein said positioning means is a fork lift loader for lifting and placing a conveyor unit on said launch vehicle with ground engaging means of said conveyor unit received in said supporting and guiding means.

21. The apparatus set forth in claim 17, wherein said launch vehicle includes a discharge conveyor fed by said receiving conveyor, said discharge conveyor feeding aggregate material to a delivery location.

22. The apparatus set forth in claim 12, wherein said coupling means includes a pair of spaced clevises at a first end of the conveyor units and a pair of spaced tongues at a second, opposite end of the conveyor units.

23. The apparatus set forth in claim 22, wherein said spaced clevises at a first end of one conveyor unit cooperatively receive said spaced tongues at a second end of an adjacent, aligned conveyor unit.

24. The apparatus set forth in claim 23, further including a load bearing pin fixed to each clevis and slot means on each tongue for receiving said load bearing pin of a cooperating clevis.

25. The apparatus set forth in claim 24, further including a locking pin received in each tongue for capturing said load bearing pin and holding said coupling means together.

26. The apparatus set forth in claim 25, wherein said coupling means provides for free angular movement through 19° about a horizontal axis defined by said load bearing pin so as to allow said individual conveyor units to follow changes to pitch in the mine floor.

27. The apparatus set forth in claim 26, wherein said coupling provides two inches or less of free play in the vertical direction and one-quarter inch or less of free play in the horizontal direction so as to be semi-rigid and prevent buckling of said conveyor means as said apparatus is advanced into said seam.

28. An apparatus for mining aggregate material from a seam, comprising:

self-propelled mining means for winning aggregate material from the seam;

means for conveying won aggregate material from said self-propelled mining means for recovery, said means for conveying being coupled to said self-propelled mining means so as to follow said mining means into the seam; and means for actively pushing said conveying means with said self-propelled mining means into the seam as the aggregate material is being won without interrupting the flow of aggregate material.

29. A method of continuously mining aggregate material from a seam utilizing a mining means and conveying means, comprising the steps of:

cutting aggregate material from the seam;

conveying aggregate material cut from the seam to a recovery location;

advancing the mining means and conveying means into the seam by actively pulling said conveying means from a forward end and actively pushing said conveying means at a rearward end; and extending said conveying means without interrupting conveying of aggregate material.

* * * * *